US006629476B2

(12) United States Patent
Fielder et al.

(10) Patent No.: US 6,629,476 B2
(45) Date of Patent: Oct. 7, 2003

(54) BI-CENTER BIT ADAPTED TO DRILL CASING SHOE

(75) Inventors: Coy M. Fielder, Cypress, TX (US); Rogerio H. Silva, Spring, TX (US)

(73) Assignee: Diamond Products International, Inc., Houston, TX (US)

( * ) Notice: Subject to any disclaimer, the term of this patent is extended or adjusted under 35 U.S.C. 154(b) by 0 days.

(21) Appl. No.: 09/969,444

(22) Filed: Oct. 2, 2001

(65) Prior Publication Data

US 2002/0092378 A1 Jul. 18, 2002

Related U.S. Application Data

(62) Division of application No. 09/392,043, filed on Sep. 8, 1999, now Pat. No. 6,340,064.
(60) Provisional application No. 60/118,518, filed on Feb. 3, 1999.

(51) Int. Cl.[7] ..... B21K 5/04
(52) U.S. Cl. ..... 76/108.2; 175/385; 175/391
(58) Field of Search ..... 76/108.1, 108.2; 175/385, 391, 334, 399

(56) References Cited

U.S. PATENT DOCUMENTS 5,678,644 A * 10/1997 Fielder ..... 175/391
5,803,196 A 9/1998 Fielder ..... 175/431
5,873,422 A 2/1999 Hansen et al. ..... 175/399
5,992,548 A * 11/1999 Silva et al. ..... 175/391
6,039,131 A * 3/2000 Beaton ..... 175/376
6,340,064 B2 * 1/2002 Fielder et al. ..... 175/385

FOREIGN PATENT DOCUMENTS

GB 2 328 698 A 3/1999 ..... 10/26

OTHER PUBLICATIONS

Article Entitled "Latest Generation Bi–Center Bit Bust Show, Drills Ahead" dated 1999, S. Silverman.

* cited by examiner

*Primary Examiner*—Hwei-Siu Payer
(74) *Attorney, Agent, or Firm*—Gregory M. Luck; Sankey & Luck, L.L.P.

(57) ABSTRACT

The invention is directed to a bi-center drilling tool adapted to fit within and drill through a casing shoe without damage to the surrounding casing. In one embodiment, the tool comprises a bit body having a proximal and a distal end where the distal end defines a pilot bit and an intermediate reamer section, where each the pilot and reamer sections define a bit face including primary and secondary cutting blades and cutting elements disposed on said blades. In this embodiment, the cutting or wear elements disposed on the one or more cutting blades which extend to or are proximate to the pass-through gauge define a selected angle between the line of contact on the cutting or wear elements and the material to be drilled.

14 Claims, 10 Drawing Sheets

BI-CENTER BIT ADAPTED TO DRILL CASING SHOE

CROSS-REFERENCE TO RELATED APPLICATIONS

This application is a divisional of application Ser. No. 09/392,043 as filed on Sep. 8, 1999 now U.S Pat. No. 6,340,064 which in turn depends from and incorporates the subject matter of provisional application Serial. No. 06/118, 518 as filed on Feb. 3, 1999.

BACKGROUND OF THE INVENTION

1. Field of the Invention

The present invention is directed to downhole tools. More specifically, the present invention is directed to a bi-center drilling bit adapted to fit within and drill through a casing shoe without damage to the surrounding casing.

2. Background

Bi-center bits are adapted for insertion down a wellbore having a given diameter where, once in position, the rotation of the bi-center bit creates a borehole having a selectedly greater diameter than the borehole.

In conventional bi-center bits, the bit is designed to rotate about a rototial axis which generally corresponds to the rotational axis defined by the drill string. Such conventional designs are further provided with cutting elements positioned about the face of the tool to reveal a low backrake angle so as to provide maximum cutting efficiency.

Disadvantages of such conventional bi-center bits lie in their inability to operate as a cutting tool within their pass-through diameter while still retaining the ability to function as a traditional bi-center bit. In such a fashion, a conventional bi-center bit which is operated within casing of its pass-through diameter will substantially damage, if not destroy the casing.

SUMMARY OF THE INVENTION

The present invention addresses the above and other disadvantages of prior bi-center drilling bits by allowing selective modification of the use of the tool within the borehole.

In one embodiment, the present invention includes a drill bit body which defines a pilot section, a reamer section and a geometric axis. The pilot section defines a typical cutting surface about which is disposed a plurality of cutting elements. These elements are situated about the cutting face to generally define a second rototional axis separate from the rotational axis defined by the drill string as a whole. This second or pass-through axis is formed by the rotation of the bit about the pass-through diameter.

In one embodiment, the pilot section may define a smaller diametrical cross-section so as to further prevent the possibility of damage to the borehole and/or casing when the bit is rotated about the pass-through axis. To further accomplish this goal, a gauge pad may also be situated on the drill bit body opposite the reamer. In yet other embodiments, cutters emphasizing a high back rake angle are employed on the peripheral cutting blades of the tool.

The present invention presents a number of advantages over prior art bi-center bits. One such advantage is the ability of the bi-center bit to operate within a borehole or casing approximating its pass-through diameter without damaging the borehole or casing. In the instance of use in casing, the casing shoe may thus be drilled through.

A second advantage is the ability of the same tool to be used as a conventional bi-center bit to create a borehole having a diameter greater than its pass-through diameter. In such a fashion, considerable cost savings may be observed since only one tool need be used where this tool need not be retrieved to the surface to modify its character of use.

Other advantages of the invention will become obvious to those skilled in the are in light of the figures and the detailed description of the preferred embodiments.

Figure 1:
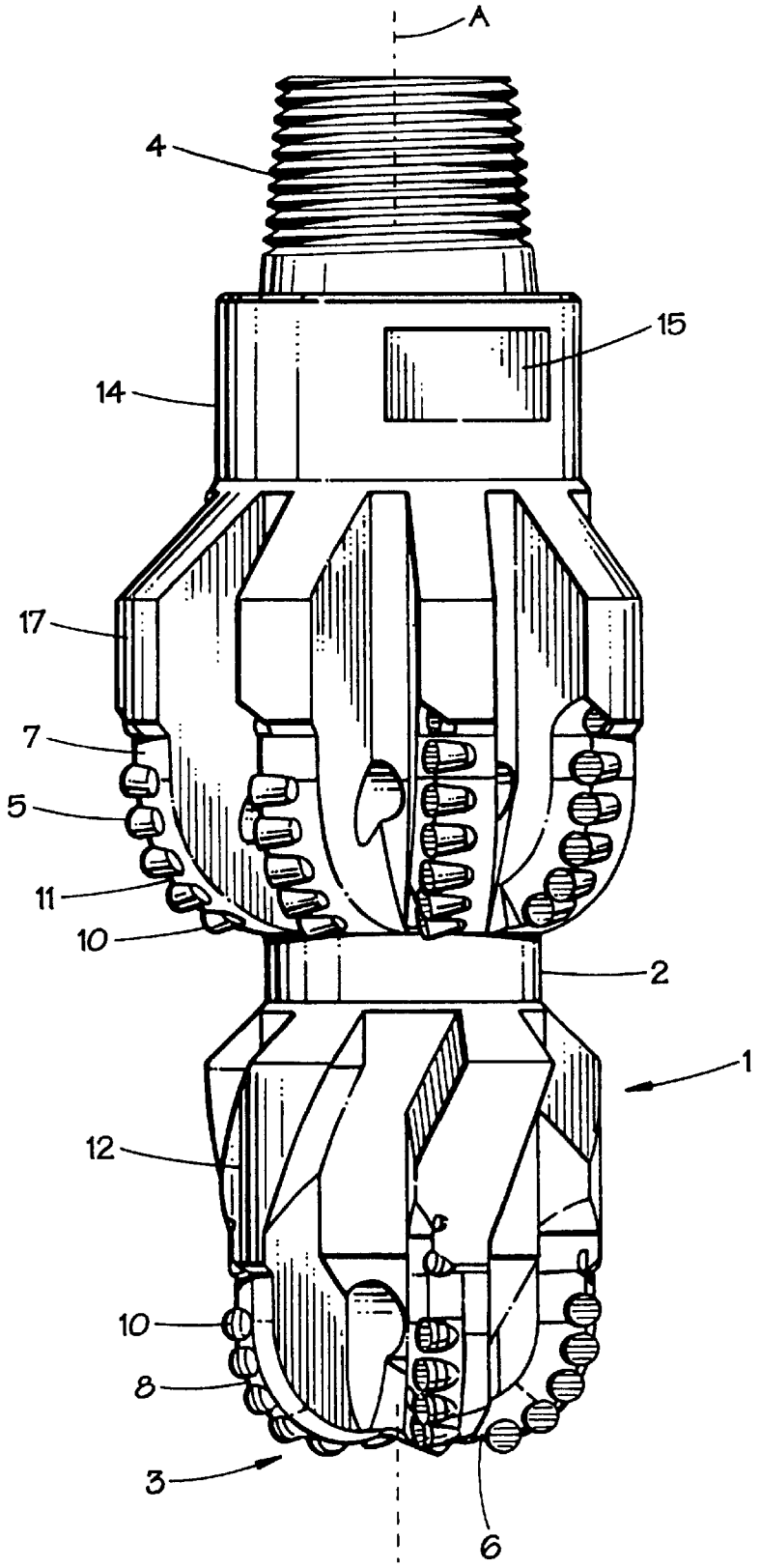
FIG. 1 is a side view of a conventional bi-center drill bit.

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

DESCRIPTION OF THE PREFERRED EMBODIMENTS

FIGS. 1–9 generally illustrate a conventional bi-center bit 1 and its method of operating in the borehole.

By reference to these figures, bit body 2, manufactured from steel or other hard metal, includes a threaded pin 4 at one end for connection in the drill string, and a pilot bit 3 defining an operating end face 6 at its opposite end. A reamer section 5 is integrally formed with the body 2 between the pin 4 and the pilot bit 3 and defines a second operating end face 7, as illustrated. The term "operating end face" as used herein includes not only the axial end or axially facing portion shown in FIG. 2, but also contiguous areas extending up along the lower sides of the bit 1 and reamer 5.

The operating end face 6 of bit 3 is transversed by a number of upsets in the form of ribs or blades 8 radiating from the lower central area of the bit 3 and extending across the underside and up along the lower side surfaces of said bit 3. Ribs 8 carry cutting members 10, as more fully described below. Just above the upper ends of rib 8, bit 3 defines a gauge or stabilizer section, including stabilizer ribs or gauge pads 12, each of which is continuous with a respective one of the cutter carrying rib 8. Ribs 8 contact the walls of the borehole that has been drilled by operating end face 6 to centralize and stabilize the tool 1 and to help control its vibration. (See FIG. 4).

Figure 2:
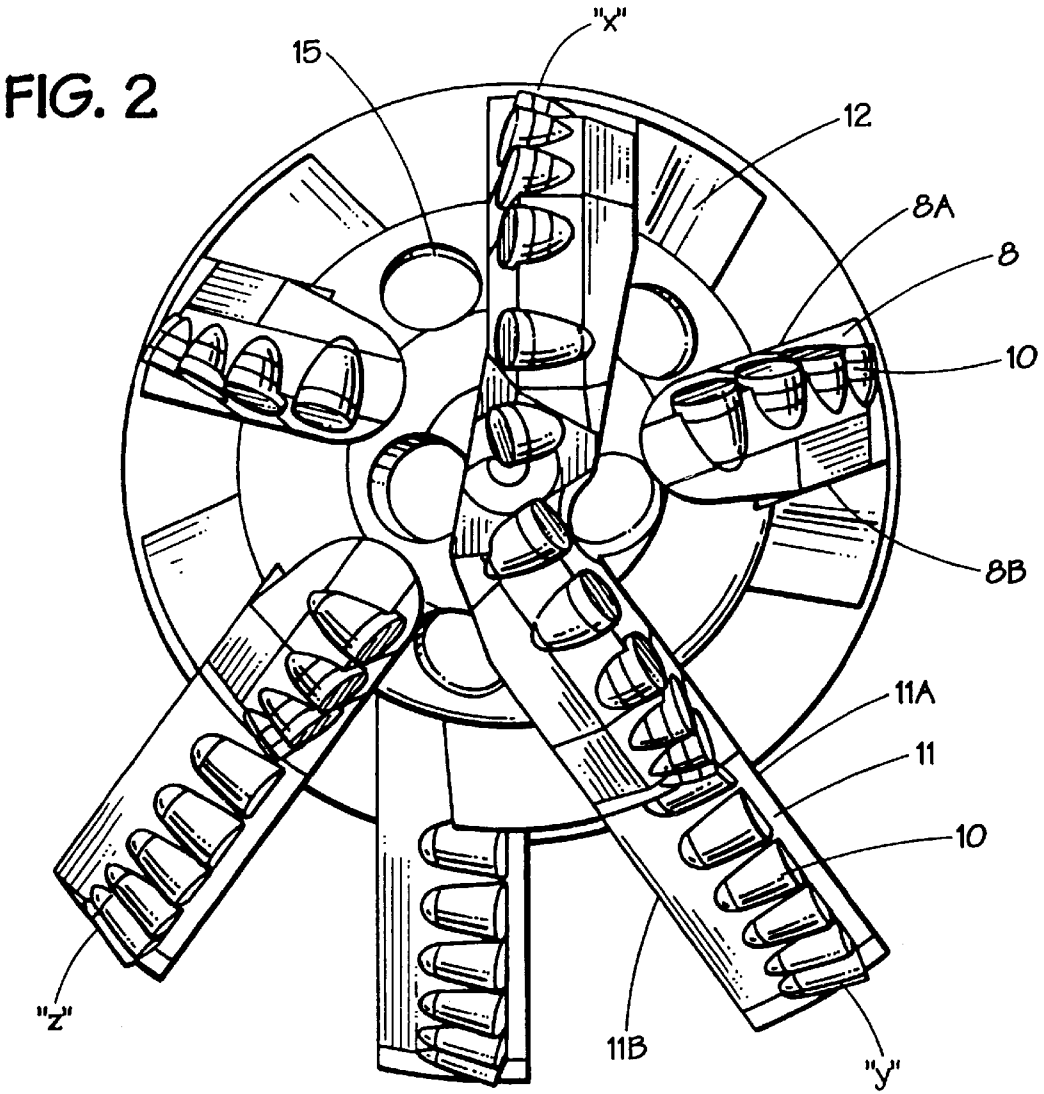
FIG. 2 is an end view of the working face of the bi-center drill bit illustrated in FIG. 1.
Figure 3C:
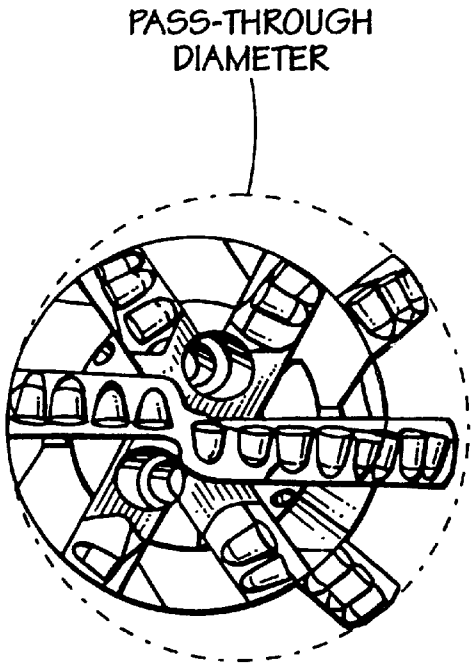
FIGS. 3A–C are end views of a bi-center bit as positioned in a borehole illustrating the pilot bit diameter, the drill hole diameter and pass through diameter, respectively.
Figure 3B:
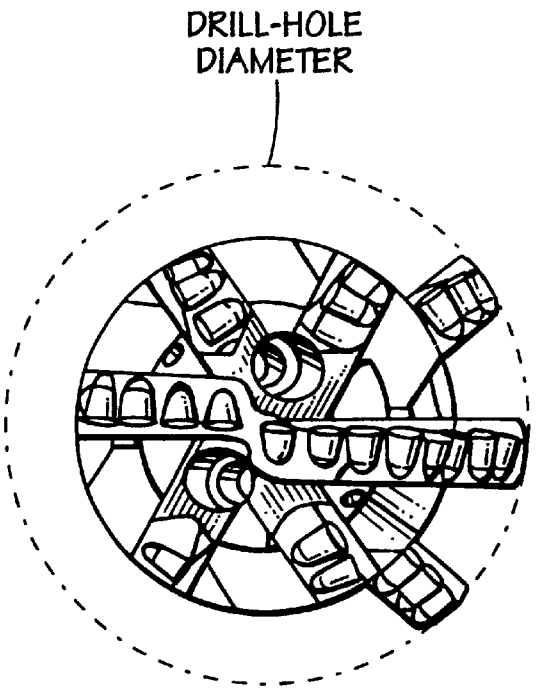
Figure 3A:
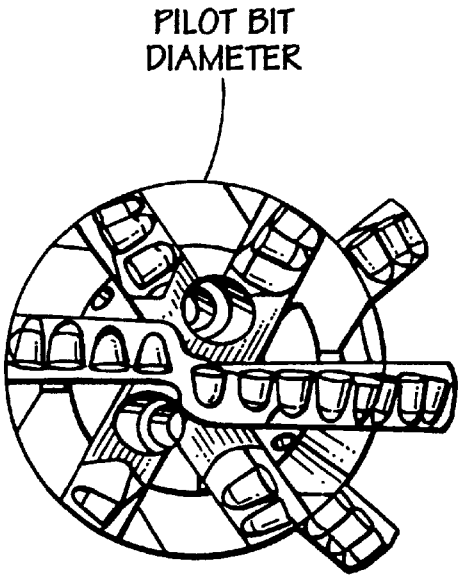
Figure 4B:
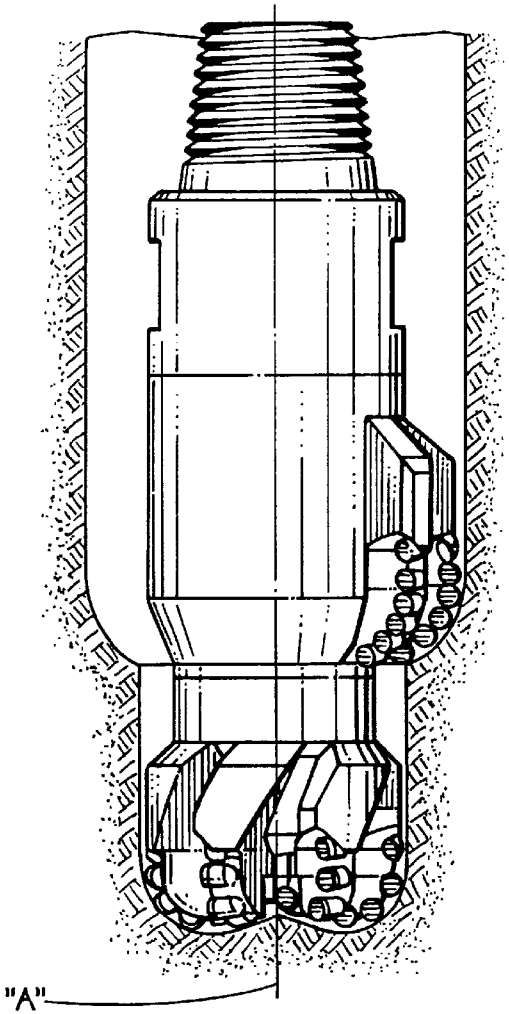
FIGS. 4A–B illustrate a conventional side view of a bi-center bit as it may be situated in casing and in operation, respectively.
Figure 4A:
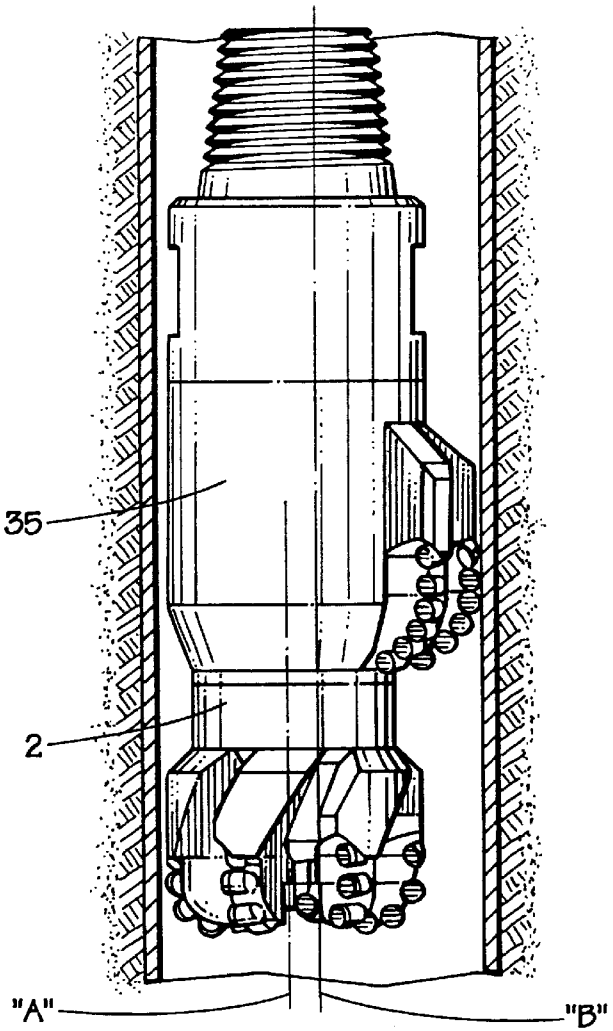
Figure 5:
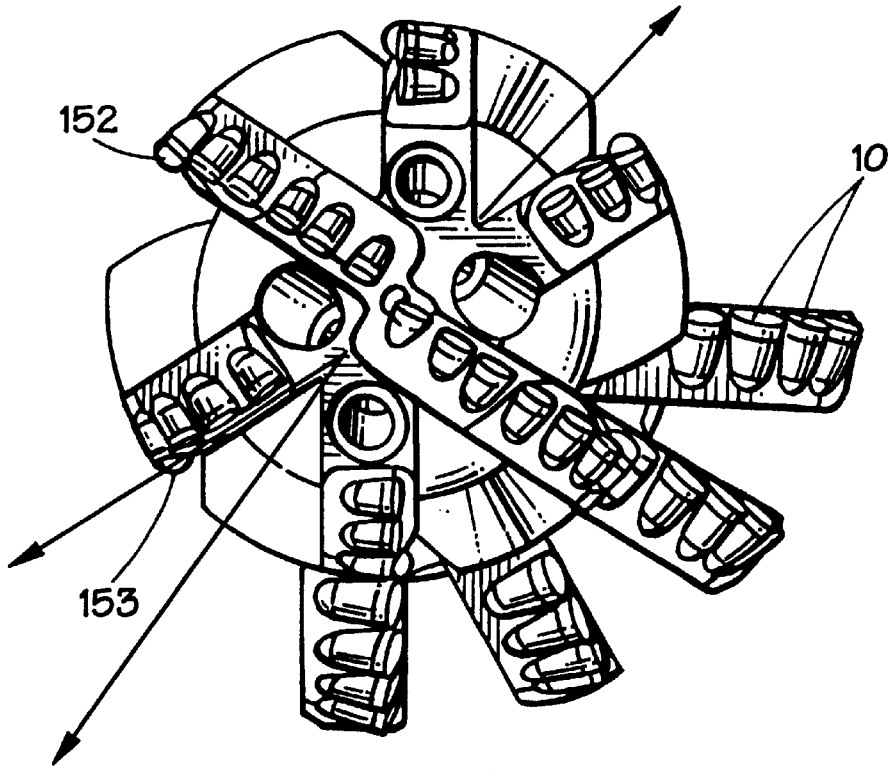
FIG. 5 is an end view of a conventional bi-center bit.

The pass-through diameter of the bi-center is defined by the three points where the cutting blades are at gauge. These three points are illustrated at FIG. 2 are designated "x," "y" and "z." Reamer section 5 includes two or more blades 11 which are eccentrically positioned above the pilot bit 3 in a manner best illustrated in FIG. 2. Blades 11 also carry cutting elements 10 as described below. Blades 11 radiate from the tool axis but are only positioned about a selected portion or quadrant of the tool when viewed in end cross section. In such a fashion, the tool 1 may be tripped into a hole having a diameter marginally greater than the maximum diameter drawn through the reamer section 5, yet be able to cut a drill hole of substantially greater diameter than the pass-through diameter when the tool 1 is rotated about the geometric or rotational axis "A." The axis defined by the pass-through diameter is identified at "B." (See FIGS. 4A–B.)

In the conventional embodiment illustrated in FIG. 1, cutting elements 10 are positioned about the operating end face 7 of the reamer section 5. Just above the upper ends of rib 11, reamer section 5 defines a gauge or stabilizer section, including stabilizer ribs or kickers 17, each of which is continuous with a respective one of the cutter carrying rib 11. Ribs 11 contact the walls of the borehole that has been drilled by operating end face 7 to further centralize and stabilize the tool 1 and to help control its vibration.

Intermediate stabilizer section defined by ribs 11 and pin 4 is a shank 14 having wrench flats 21 that may be engaged to make up and break out the tool 1 from the drill string (not illustrated). By reference again to FIG. 2, the underside of the bit body 2 has a number of circulation ports or nozzles 15 located near its centerline. Nozzles 15 communicate with the inset areas between ribs 8 and 11, which areas serve as fluid flow spaces in use.

Figure 6:
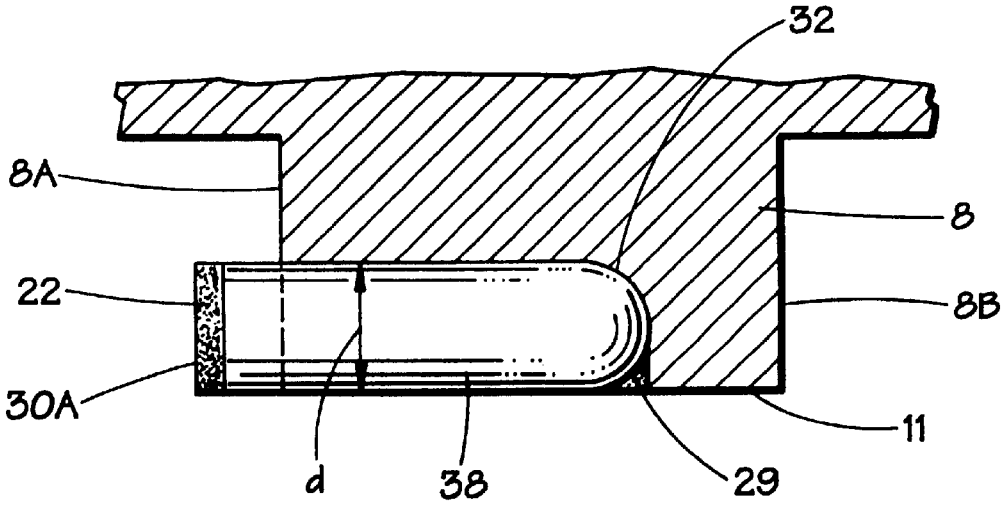
FIG. 6 illustrates a cutting structure brazed in place within a pocket milled into a rib of a conventional bi-center drill bit.
Figure 9:
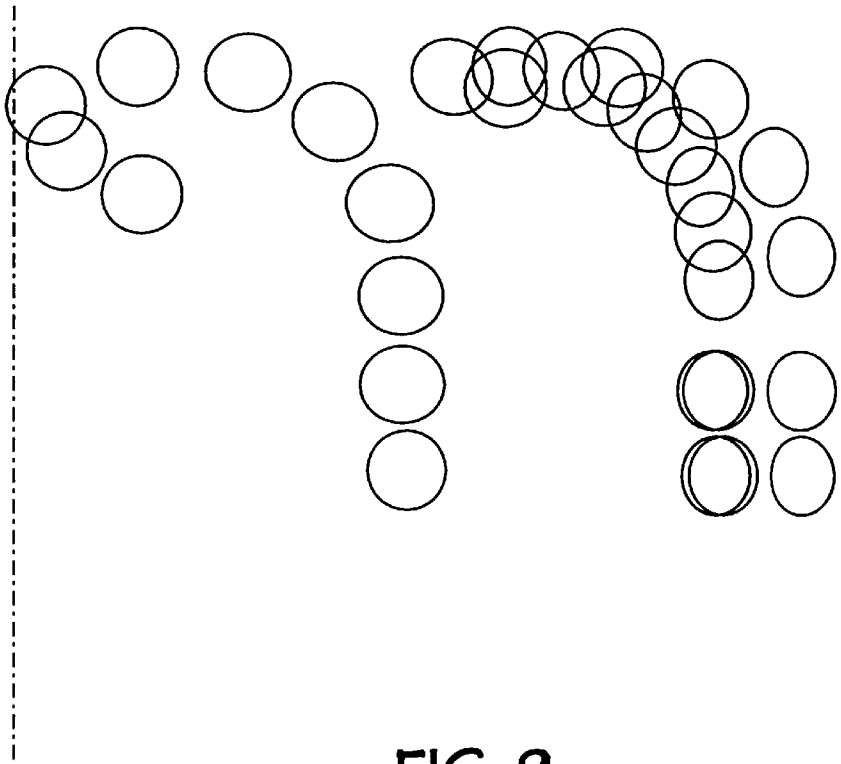
FIG. 9 illustrates a revolved section of a conventional pilot section cutter coverage as drawn about the pass-through axis.

With reference now to FIGS. 1 and 2, bit body 2 is intended to be rotated in the clockwise direction, when viewed downwardly, about axis "A." Thus, each of the ribs 8 and 11 has a leading edge surface 8A and 11A and a trailing edge surface 8B and 11B, respectively. As shown in FIG. 6, each of the cutting members 10 is preferably comprised of a mounting body 38 comprised of sintered tungsten carbide or some other suitable material, and a layer 22 of polycrystalline diamond carried on the leading face of said mounting body 38 having a diameter "d" and defining the cutting face 30A of the cutting member. The cutting members 10 are mounted in the respective ribs 8 and 11 so that their cutting faces are exposed through the leading edge surfaces 8A and 11A, respectively.

In the conventional bi-center bit illustrated in FIGS. 1–9, cutting members 10 are mounted so as to position the cutter face 30A at an aggressive, low angle, e.g., 15–20° backrake, with respect to the formation. This is especially true of the cutting members 10 positioned at the leading edges of bit body 2. Ribs 8 and 11 are themselves preferably comprised of steel or some other hard metal. The tungsten carbide cutter body 38 is preferably brazed into a pocket 32 and includes within the pocket the excess braze material 29.

Figure 7:
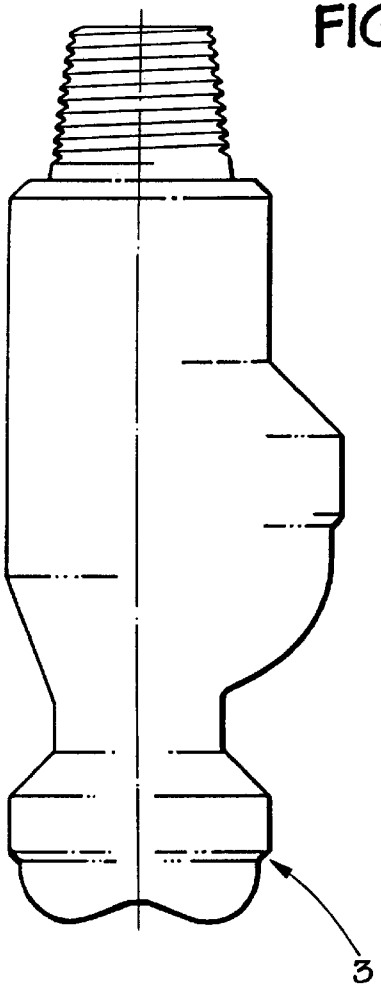
FIG. 7 illustrates a schematic outline view of an exemplary bi-center bit of the prior art.

As illustrated in profile in FIG. 7, the conventional bi-center bit normally includes a pilot section 3 which defined an outside diameter at least equal to the diameter of bit body 2. In such a fashion, cutters on pilot section 3 may cut to gauge.

Figure 8:
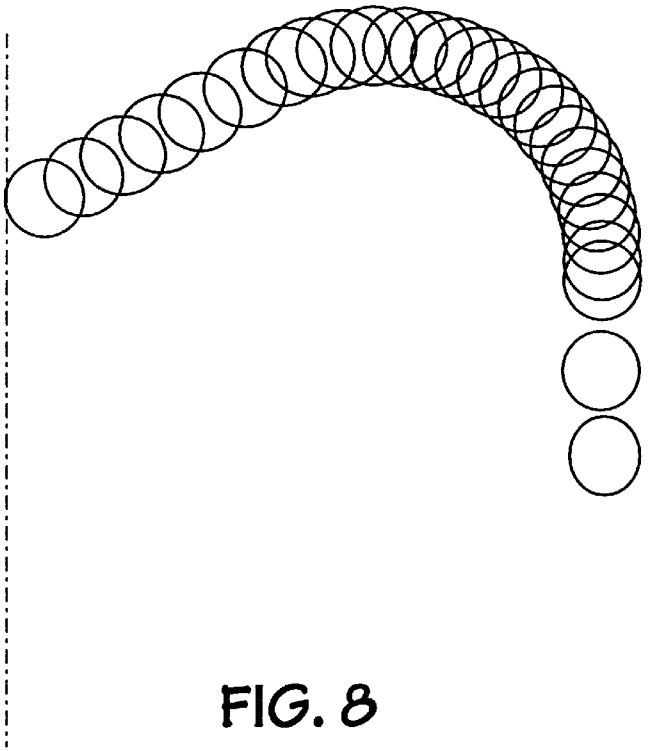
FIG. 8 illustrates a revolved section of a conventional pilot section cutter coverage as drawn about the geometric axis.

The cutter coverage of a conventional bi-center bit may be viewed by reference to a section rotated about a given axis. FIG. 8 illustrates the cutter coverage for the pilot bit illustrated in FIGS. 1–2. The revolved section identifies moderate to extreme coverage overlap of the cutters, with the maximum overlap occurring at the crown or bottommost extent of pilot section 3 when said pilot section 3 is rotated about geometric axis "A." The cutter coverage illustrated in FIG. 8 should be compared with the absence of cutter coverage occurring when pilot section 3 is rotated about the pass-through axis "B." (See FIG. 9.) Clearly, the bi-center bit illustrated in FIG. 9 would be inefficient if used in hard or resilient formations such as a casing shoe.

When a conventional bi-center bit is rotated about its rotational axis "A," the bit performs in the manner earlier described to create a borehole having a diameter larger than its pass-through diameter. (See FIGS. 4A–4B.) This result is not desirable when the bit is used in casing to drill through a casing shoe since, while the shoe might be removed, the casing above the shoe would also be damaged. Consequently, it has become accepted practice to drill through a casing shoe using a conventional drill bit which is thereafter retrieved to the surface. A bi-center bit is then run below the casing to enlarge the borehole. However, the aforedescribed procedure is costly, especially in deep wells when many thousand feet of drill pipe may need be tripped out of the well to replace the conventional drilling bit with the bi-center bit. The bi-center bit of the present invention addresses this issue.

Figure 10:
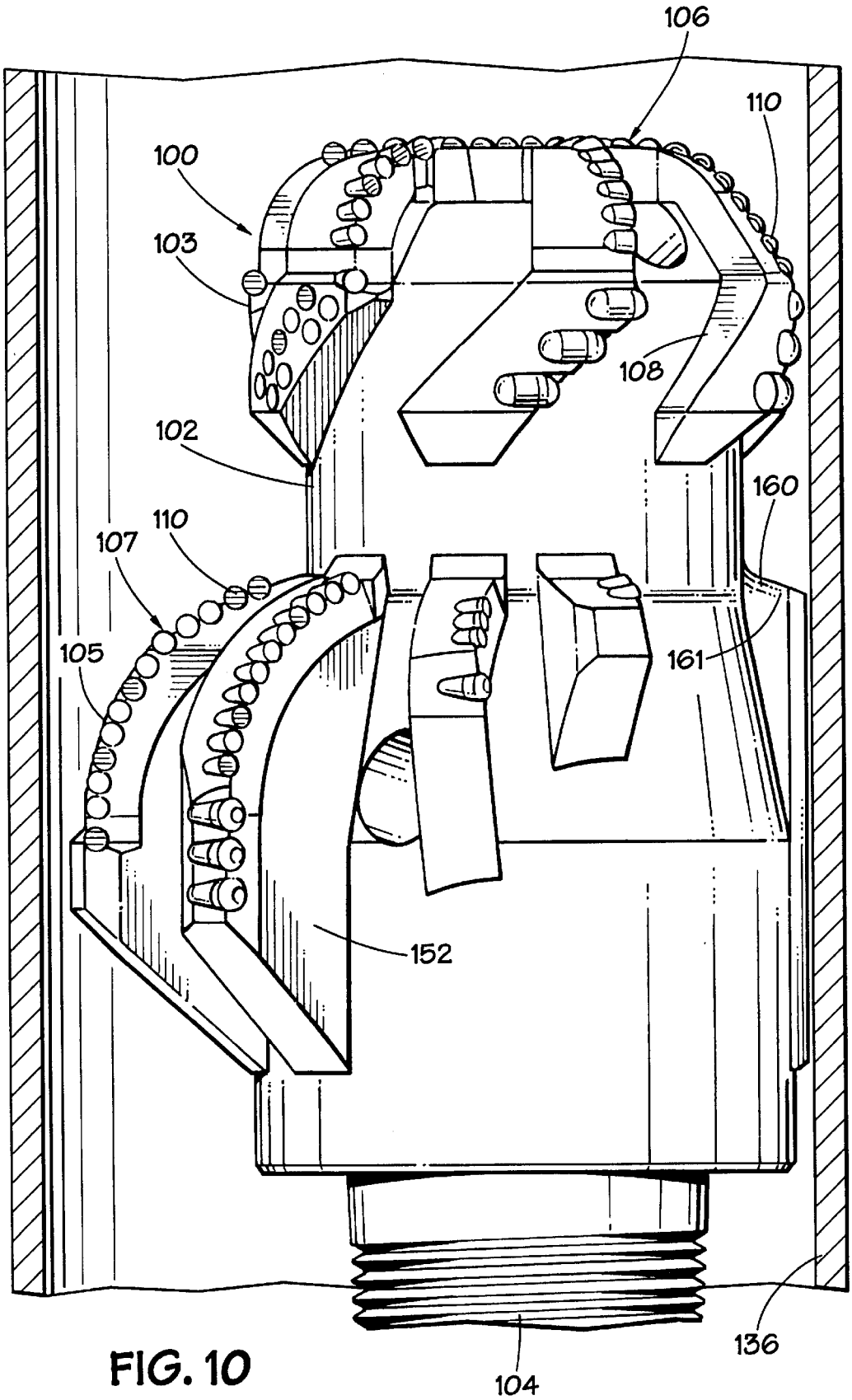
FIG. 10 illustrates a side view of one embodiment of the bi-center bit of the present invention.

One embodiment of the bi-center bit of the present invention may be seen by reference to FIGS. 10–15. FIG. 10 illustrates a side view of a preferred embodiment of the bi-center bit of the present invention. By reference to the figures, the bit 100 comprises a bit body 102 which includes a threaded pin at one end 104 for connection to a drill string and a pilot bit 103 defining an operating end face 106 at its opposite end. For reasons discussed below, end face 106 defines a flattened profile. A reamer section 105 is integrally formed with body 102 between the pin 104 and pilot bit 103 and defines a second operating end face 107.

The operating end face 106 of pilot 103 is traversed by a number of upsets in the form of ribs and blades 108 radiating from the central area of bit 103. As in the conventional embodiment, ribs 108 carry a plurality of cutting members 110. The reamer section 105 is also provided with a number of blades or upsets 153, which upsets are also provided with a plurality of cutting elements 110 which themselves define cutting faces.

The embodiment illustrated in FIG. 10 is provided with a pilot section 103 defining a smaller cross-section of diameter than the conventional embodiment illustrated in FIGS. 1–8. The use of a lesser diameter for pilot section 103 serves to minimize the opportunity for damage to the borehole or casing when the tool 100 is rotated about the pass-through axis "B."

In a conventional bit, cutters 110 which extend to gauge generally include a low backrake angle for maximum efficiency in cutting. (See FIG. 11.) In the bi-center bit of the present invention, it is desirable to utilize cutting elements which define a less aggressive cutter posture where they extend to gauge when rotating about the pass-through axis. In this connection, it is desirable that cutters 110 at the pass-through gauge and positioned on the leading and trailing blades 118 define a backrake angle of between 30–90 degrees with the formation. (See FIG. 11.) Applicant has discovered that a preferred backrake angle for soft to medium formations is 55 degrees. The orientation of cutting elements 110 to define such high backrake angles further reduces the potential for damage to casing 136 when the tool 100 is rotated about the pass-through axis "B."

In a preferred embodiment, bit 100 may be provided with a stabilizer pad 160 opposite reamer section 105. Pad 160 may be secured to bit body 102 in a conventional fashion, e.g., welding, or may be formed integrally. Pad 160 serves to define the outer diametrical extent of tool 100 opposite pilot 103. (See FIG. 10.) It is desirable that the uppermost extent 161 of pad 160 not extend beyond the top of cutters 110 on reamer blades 152.

When rotated in the casing, the tool 100 is compelled to rotate about pass-through axis "B" due to the physical constraints of casing 136. Casing 136 is not cut since contact with tool 100 is about the three points defined by leading edges 118 and stabilizer pad 160. As set forth above, edges 118 include cutting elements having a high backrake angle not suited to cut casing 136. Likewise, pad 160 is not adapted to cut casing 136. The cutters disposed elsewhere about operating face 107 incorporate a backrake angle of 15°–30° and thus are able to cut through the casing shoe. When the casing shoe has been cut, the tool 100 is able to rotate free of the physical restraints imposed by casing 136. In such an environment, the tool reverts to rotation about axis "A. "

The method by which the bi-center bit of the present invention may be constructed may be described as follows. In an exemplary bi-center bit, a cutter profile is established for the pilot bit. Such a profile is illustrated, for example, in FIG. 8 as drawn through the geometrical axis of the tool. The pass-through axis is then determined from the size and shape of the tool.

Once the pass-through diameter is determined, a cutter profile of the tool is made about the pass-through axis. This profile will identify any necessary movement of cutters 110 to cover any open, uncovered regions on the cutter profile. These cutters 110 may be situated along the primary upset 131 or upsets 132 radially disposed about geometric axis "A."

Once positioning of the cutters 110 has been determined, the position of the upsets themselves must be established. In the example where it has been determined that a cutter 110 must be positioned at a selected distance $r_1$, from pass-through axis "B," an arc 49 is drawn through $r_1$ in the manner illustrated in FIG. 15. The intersection of this arc 49 and a line drawn through axis "A" determines the possible positions of cutter 110 on radially disposed upsets 132.

To create a workable cutter profile for a bi-center bit which includes a highly tapered or contoured bit face introduces complexity into the placement of said cutters 110 since issues of both placement and cutter height must be addressed. As a result, it has been found preferable to utilize a bit face which is substantially flattened in cross section. (See FIG. 10.)

Figure 11:
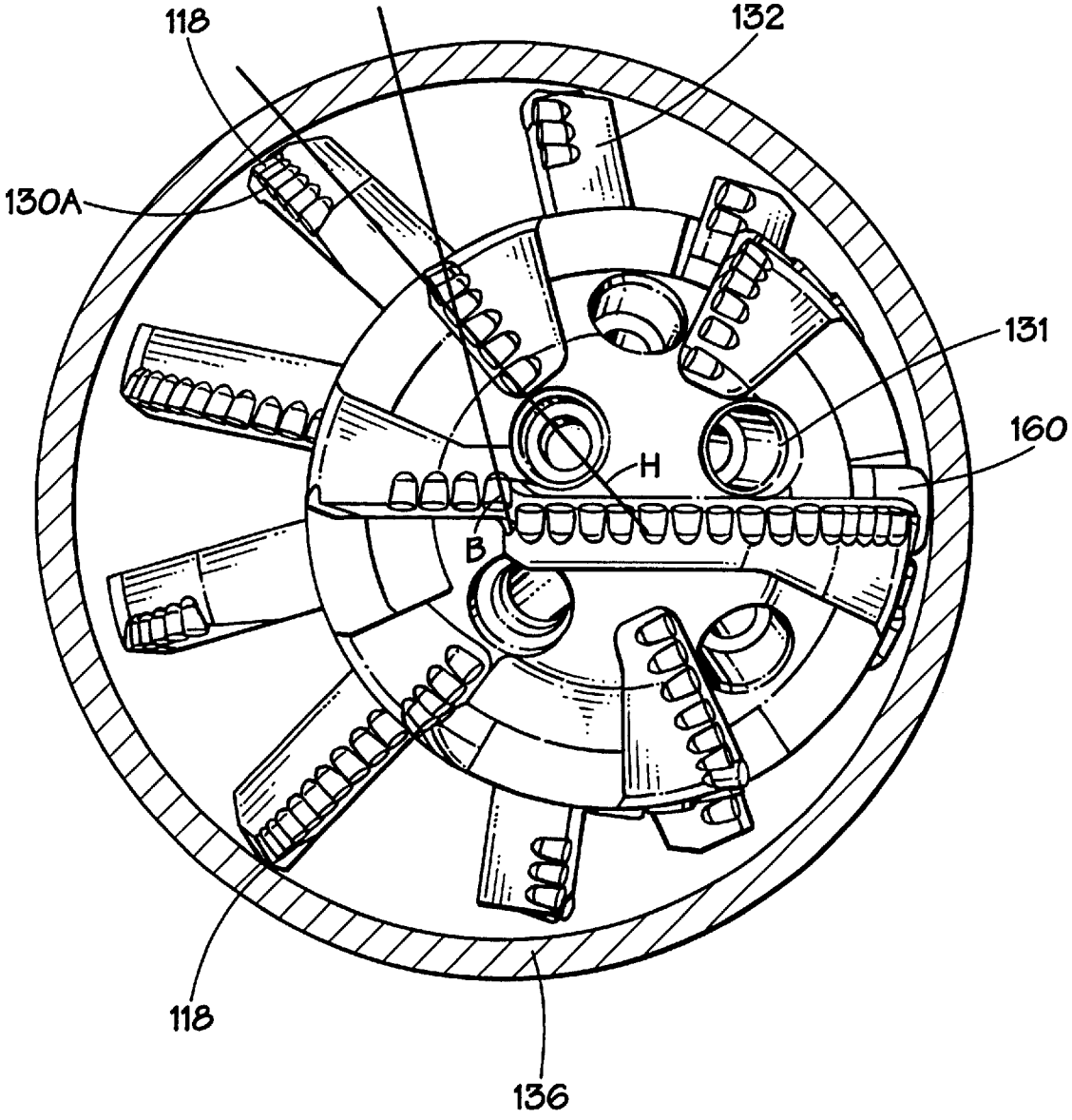
FIG. 11 illustrates an end view of the bi-center bit illustrated in FIG. 10.
Figure 13:
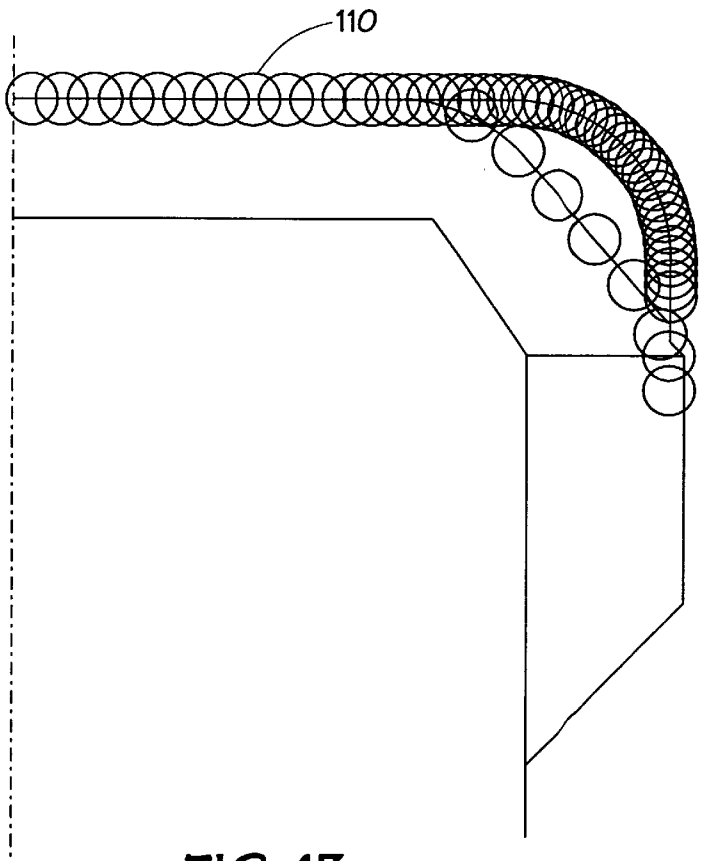
FIG. 13 illustrates a revolved section of the pilot section of the bi-center bit illustrated in FIG. 10, as drawn through the geometric axis.
Figure 12:
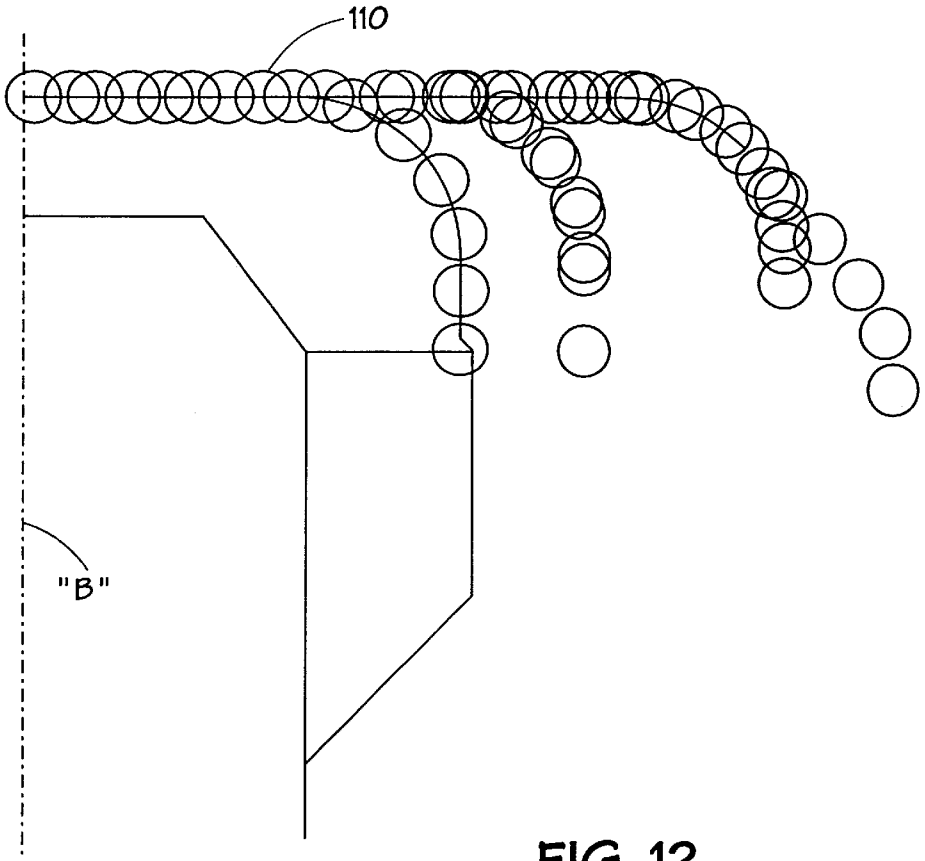
FIG. 12 illustrates a revolved section of the pilot section of the bi-center bit illustrated in FIG. 10, as drawn through the pass-through axis.
Figure 15:
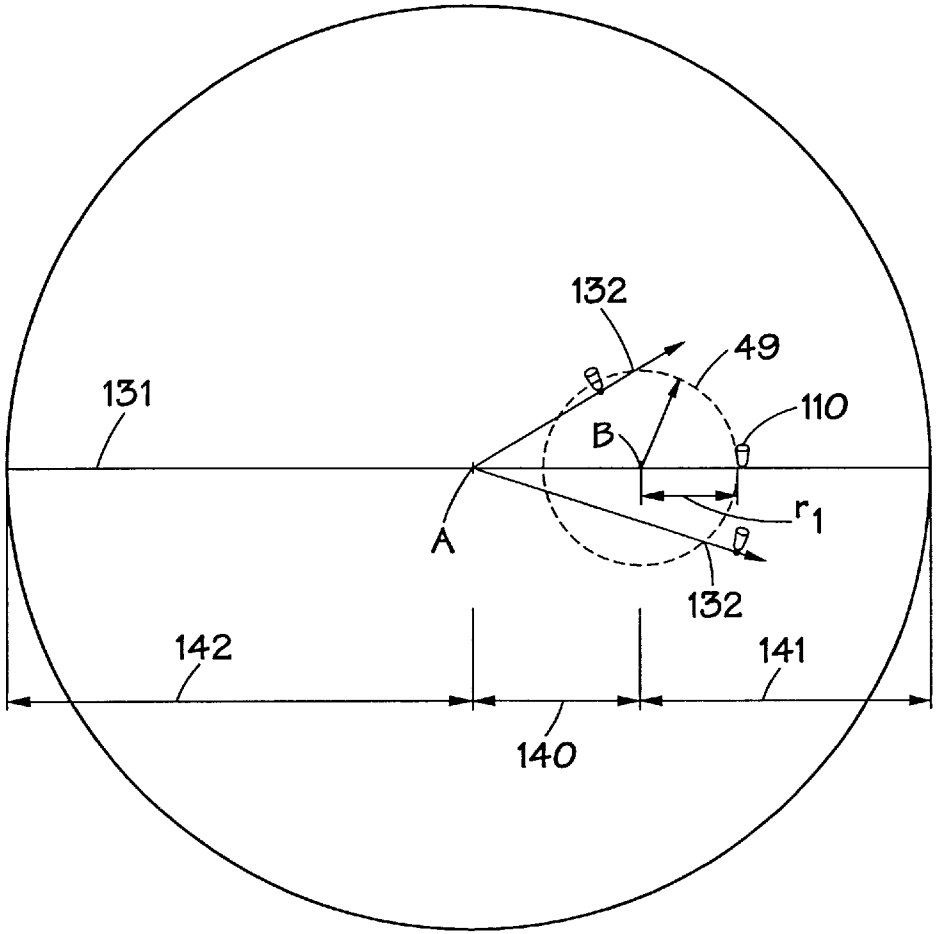
FIG. 15 illustrates a schematic view of the orientation of cutters in one preferred embodiment of the invention.
Figure 14:
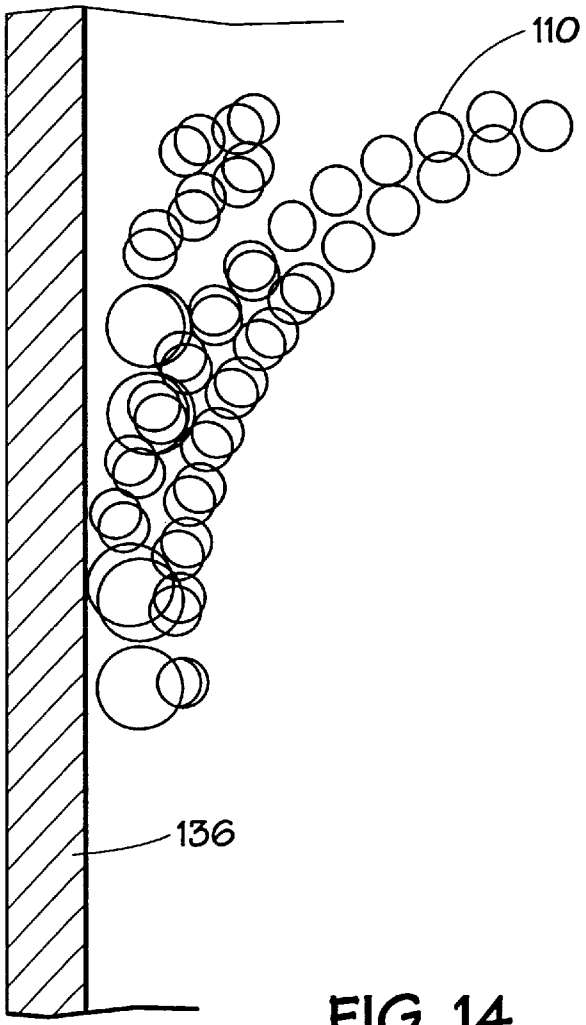
FIG. 14 illustrates a graphic profile of the cutters positioned on the reamer section of the embodiment illustrated in FIG. 10.

Once positioning of the upsets has been determined, the cutters 110 must be oriented in a fashion to optimize their use when tool 100 is rotated about both the pass-through axis "B" and geometric axis "A." By reference to FIGS. 11 and 15, cutters 110 positioned for use in a conventional bi-center bit will be oriented with their cutting surfaces oriented toward the surface to the cut, e.g., the formation. In a conventional bi-center bit, however, cutters 110 so oriented on the primary upset 131 in the area 140 between axes "A" and "B" will actually be oriented 180° to the direction of cut when tool 100 is rotated about pass-through axis "B." To address this issue, it is preferable that at least most of cutters 110 situated on primary upset 131 about area 140 be oppositely oriented such that their cutting faces 130A are brought into contact with the formation or the casing shoe, as the case may be, when tool 100 is rotated about axis "B." This opposite orientation of cutter 110 is in deference to the resilient compounds often comprising the casing shoe.

Cutters 110 disposed along primary upset 131 outside of region 140 in region 141 are oriented such that their cutting faces 130A are brought into at least partial contact with the formation regardless when rotated about axis "A." Cutters 110 oppositely disposed about primary upset 131 in region 142 are oriented in a conventional fashion. (See FIG. 15.) Cutting or wear elements situated on blades which extend to or are proximate the pass-through gauge define a back angle, a skew angle and an angle between the line of contact on the cutting or wear element and the material to be drilled. This angle of contact is preferably between 5 and 45 degrees.

Cutters 110 not situated on primary upset 131 oriented are disposed on radial upsets 132. These cutters 110, while their positioning may be dictated by the necessity for cutter coverage when tool 100 is rotated about axes "A" and "B," as described above, are oriented on their respective upsets 132 or are skewed to such an angle such that at least twenty percent of the active cutter face 130A engages the formation when the bi-center bit is rotated about axis "A". Restated as a function of direction of cut, the skew angle of cutters 110 is from 0°–80°.

What is claimed is:

1. A method to fabricate a bi-center bit adapted to rotate about a pass-through axis "B" or a rotational axis "A" where the bi-center bit comprises a bit body having a proximal end and a distal end where the distal end defines a pilot bit section and an intermediate reamer section, where the pilot and reamer sections define a bit face including primary and secondary cutting blades and cutting elements disposed on said blades where each cutting element defines a cutting face, the method comprising the steps of:

fabricating a cutter profile for the bit about the rotational axis "A";

identifying the pass-through axis "B" of the bit;

fabricating a cutter profile for the bit about the pass-through axis "B"; and situating selected ones of said cutting elements on the bit face of the pilot and reamer sections such that at least a portion of each cutting element is disposed about substantially all portions of said profiles when the bit is rotated about the rotational and pass-through axes.

2. The method of claim 1 further including the step of positioning the cutting blades so that the rotational and pass-through axes fall along the primary cutting blade.

3. The method of claim 1 further including the step of positioning cutting elements on the primary cutting blade between the rotational axis "A" and the pass-through axis "B" such that substantially all of the cutting faces of said elements are brought into at least partial contact with the material to be drilled when the bit is rotated about said pass-through axis "B."

4. The method of claim 1 where the bit defines a gauge further including the step of positioning selected ones of said cutting elements on the primary cutting blade opposite said rotational axis "A" and between said pass-through axis "B" and the gauge such that the cutting faces of substantially all such elements are brought into at least partial contact with the material to be drilled when said bit is rotated about the rotational axis "A."

5. The method of claim 1 where the skew angle of cutting element of the secondary cutting blades is between 0–80°.

6. A method to fabricate a bit which defines at least two axes of rotation, where the bit includes a bit body defining a proximal end adapted to be coupled to a drill string, a distal end, a pilot section and a reamer section, where both said pilot and reamer sections include one or more cutting blades, the method comprising:

defining a rotational axis and a pass-through axis of the bit; and positioning cutting elements on the cutting blades of the pilot and reamer sections such as to create substantially complete cutter overlap when the bit is rotated about either the rotational or pass-through axis.

7. The method of claim 6 further including the step of positioning one or more stabilizing elements opposite said reamer section such that the proximal most portion of said stabilizing elements do not extend beyond the most proximal cutting elements disposed on said reamer section.

8. The method of claim 7 where said stabilizing element includes a gauge pad.

9. The method of claim 6 further including the step of orienting the cutting elements which each define a cutting face such that the cutting face of most of said elements on cutting blades situated between the rotational and pass-through axes are oriented such that they are brought into contact with the material to be drilled when the bit is rotated about the pass-through axis.

10. The method of claim 6 further including the step of orienting the cutting elements which each define a cutting face such that the cutting face of most of said elements on cutting blades situated between the rotational and pass-through axes are oriented such that they are brought into contact with the material to be drilled when the bit is rotated about the rotational axis.

11. The method of claim 6 further including the step of orienting the cutting elements which each define a cutting face such that the cutting face of most of said elements on cutting blades situated between the rotational and pass-through axes are oriented such that they are brought into contact with the material to be drilled when the bit is rotated about the rotational axis or the pass-through axis.

12. The method of claim 6 where the bit defines a pass-through gauge, further including the step of orienting the cutting elements which each define a cutting face and where the cutting blades include primary and secondary blades, where the rotational and the pass-through axes lie substantially along the primary blade such that the cutting faces of substantially all elements disposed along the primary cutting blade not between the rotational axis and the pass-through axis but between the pass-through axis and the gauge are brought into at least partial contact with the formation to be drilled when said bit is rotated about the rotational axis.

13. The method of claim 12 where the reamer section defines one or more blades which extend to the pass-through gauge further including the step of positioning cutting elements on said blades at or near the pass-through gauge so as to from an angle between the material to be drilled and the line of contact on the cutting element where said angle is between 5–45°.

14. The method of claim 12 further including the step of positioning the cutting elements on the secondary blades such that they define a skew angle of between 0–80°.

* * * * *